US010156093B2

(12) United States Patent
Hall et al.

(10) Patent No.: US 10,156,093 B2
(45) Date of Patent: Dec. 18, 2018

(54) SAFETY DETECTOR FOR MOTORIZED BLINDS

(71) Applicants: David R. Hall, Provo, UT (US); Emily Brimhall, Alpine, UT (US); Austin Carlson, Provo, UT (US); Mark Madsen, Provo, UT (US); Lloyd J. Wilson, Herriman, UT (US)

(72) Inventors: David R. Hall, Provo, UT (US); Emily Brimhall, Alpine, UT (US); Austin Carlson, Provo, UT (US); Mark Madsen, Provo, UT (US); Lloyd J. Wilson, Herriman, UT (US)

(73) Assignee: Hall Labs LLC, Provo, UT (US)

( * ) Notice: Subject to any disclaimer, the term of this patent is extended or adjusted under 35 U.S.C. 154(b) by 97 days.

(21) Appl. No.: 15/474,642

(22) Filed: Mar. 30, 2017

(65) Prior Publication Data

US 2018/0283094 A1 Oct. 4, 2018

(51) Int. Cl.

| | |
|---|---|
| ***E06B 9/325*** | (2006.01) |
| ***E06B 9/322*** | (2006.01) |
| *E06B 9/28* | (2006.01) |

(52) U.S. Cl.
CPC ..... *E06B 9/325* (2013.01); *E06B 9/322* (2013.01); *E06B 2009/285* (2013.01)

(58) Field of Classification Search
CPC ..... E06B 9/325
USPC ..... 318/466, 34
See application file for complete search history.

(56) References Cited

U.S. PATENT DOCUMENTS 7,389,806 B2 * 6/2008 Kates ..... E06B 9/32 160/5
9,810,020 B2 * 11/2017 Adams ..... E06B 9/72

* cited by examiner

*Primary Examiner* — David S Luo

(57) ABSTRACT

A headrail for a motorized window covering is described that includes a motor and a gearbox coupled to the motor that is configured to actuate a window covering. The headrail includes a safety detector with one or more sensors that detect an irregular strain when the window covering is being raised. The headrail may further comprise a recoil mechanism or a deactivation mechanism to reduce the likelihood of damage to the window coverings and/or individuals caught or tangled in the window covering.

20 Claims, 8 Drawing Sheets

SAFETY DETECTOR FOR MOTORIZED BLINDS

TECHNICAL FIELD

The present disclosure relates generally to the field of window coverings. More specifically, the present disclosure relates to a motorized headrail for window coverings.

BACKGROUND

Window coverings such as blinds may be mounted in a window or doorframe by mounting a headrail for the window covering along the top of the window or doorframe. In some window coverings, the headrail may be motorized such that various aspects of the blinds may be controlled remotely or move automatically in response to inputs and specifications. For instance, the motor may cause the window covering to raise or lower and/or open and close slats of window covering.

The motorized headrail can potentially be subjected to an unexpected load if a person is pulling against the direction of the motorized movement or if the window covering is caught on something preventing it from moving. For such instances, it may be beneficial to detect such conditions and stop motor movement. Failure to become aware of such conditions can lead to serious damage to the window coverings and/or individuals caught or tangled in the window covering. Therefore, a device is needed that detects such conditions and stops motor movement and/or reverses the motor direction and relieve tension on something that may be caught in the window covering.

SUMMARY OF THE INVENTION

The invention has been developed in response to the present state of the art and, in particular, in response to the problems and needs in the art that have not yet been fully solved by currently available apparatus and methods. Accordingly, an apparatus is disclosed herein that includes a safety detector for the headrail of motorized blinds that detects anomalous blind loads of a 10% increase in the expected load weight. The features and advantages of the invention will become more fully apparent from the following description and appended claims, or may be learned by practice of the invention as set forth hereinafter.

In a first embodiment of the invention, an apparatus in accordance with the invention includes a headrail for motorized window coverings. The headrail includes a motor and a gearbox coupled to the motor and configured to raise and lower, and/or open and close slats for the window covering. The headrail also includes a safety detector with one or more sensors attached to an output shaft of the gearbox. The safety detector, according to one embodiment, is configured to detect irregular strain on the output shaft that occurs when raising the window covering that is indicative of the anomalous load. The safety detector may include a transceiver for communicating real time sensor data to a microcontroller that in turn activates a recoil mechanism that cancels inputs and/or deactivates preprogrammed settings, and changes the motor's direction in response to a digital signal indicating that the load weight has increased at least 10%. By changing the motor's direction cords and/or strings connected to the output shaft may be loosened in order to lower the window covering.

In a second embodiment of the invention, an apparatus in accordance with the invention includes a headrail for motorized window coverings. The headrail includes a motor and a gearbox coupled to the motor and configured to raise and lower, and/or open and close slats for the window covering. The headrail also includes a safety detector where one or more sensors are attached to an output shaft of the gearbox. The safety detector, according to one embodiment, is configured to detect irregular strain on the output shaft that occurs when raising the window covering that is indicative of an anomalous load. The safety detector may include a transceiver for communicating real time sensor data to a microcontroller that then activates a deactivation mechanism. The deactivation mechanism may then deactivate the motor and stops the window covering from rising.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

It will be readily understood that the components of the present invention, as generally described and illustrated in the Figures herein, may be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
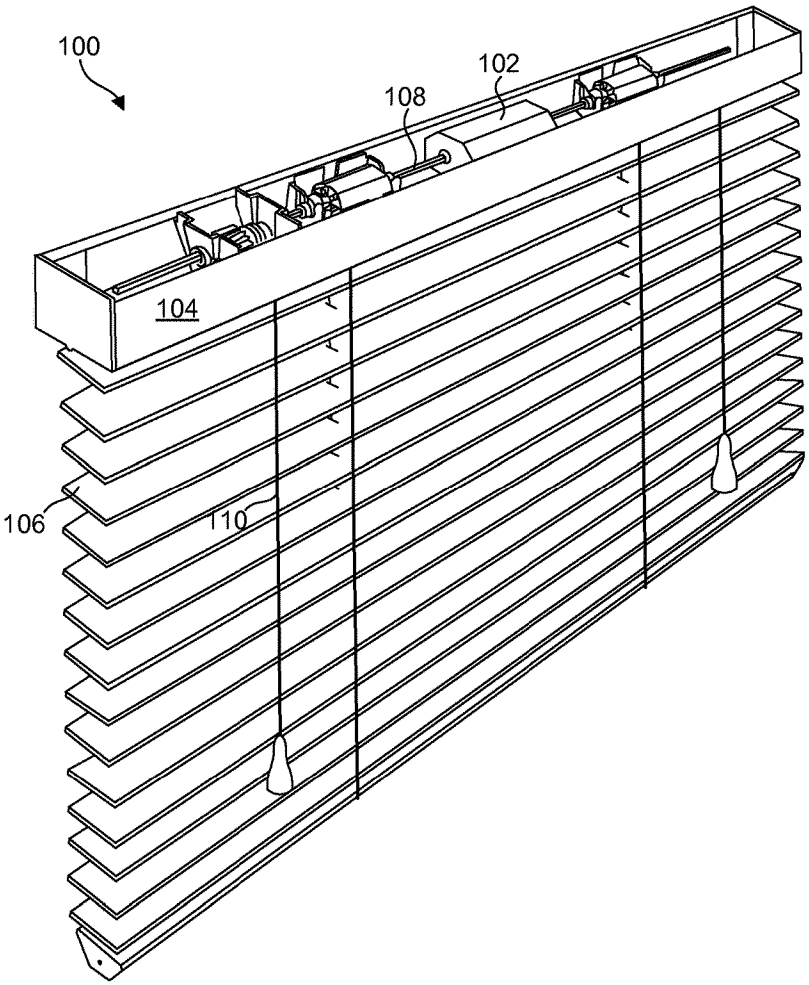
FIG. 1 is a perspective view showing one embodiment of a window covering that includes a motorized gearbox assembly.

FIG. 1 is a perspective view showing one embodiment of a window covering 100 that includes a motorized gearbox assembly 102. The window covering 100, may be a conventional window blind as illustrated. The window covering 100 may include a headrail 104, comprising various components, and slats 106. In one embodiment, manual tilt mechanisms such as tilt wands or tilt controls may be removed. The motorized gearbox assembly 102 may engage and rotate a tilt rod 108 in order to tilt the slats 106. The motorized gearbox assembly 102 may also be configured to raise and lower the window covering by reeling in and unreeling a string. In other embodiments, the motorized gearbox assembly 102 may be configured to work in tandem with manual tilt mechanisms 110.

Figure 2:
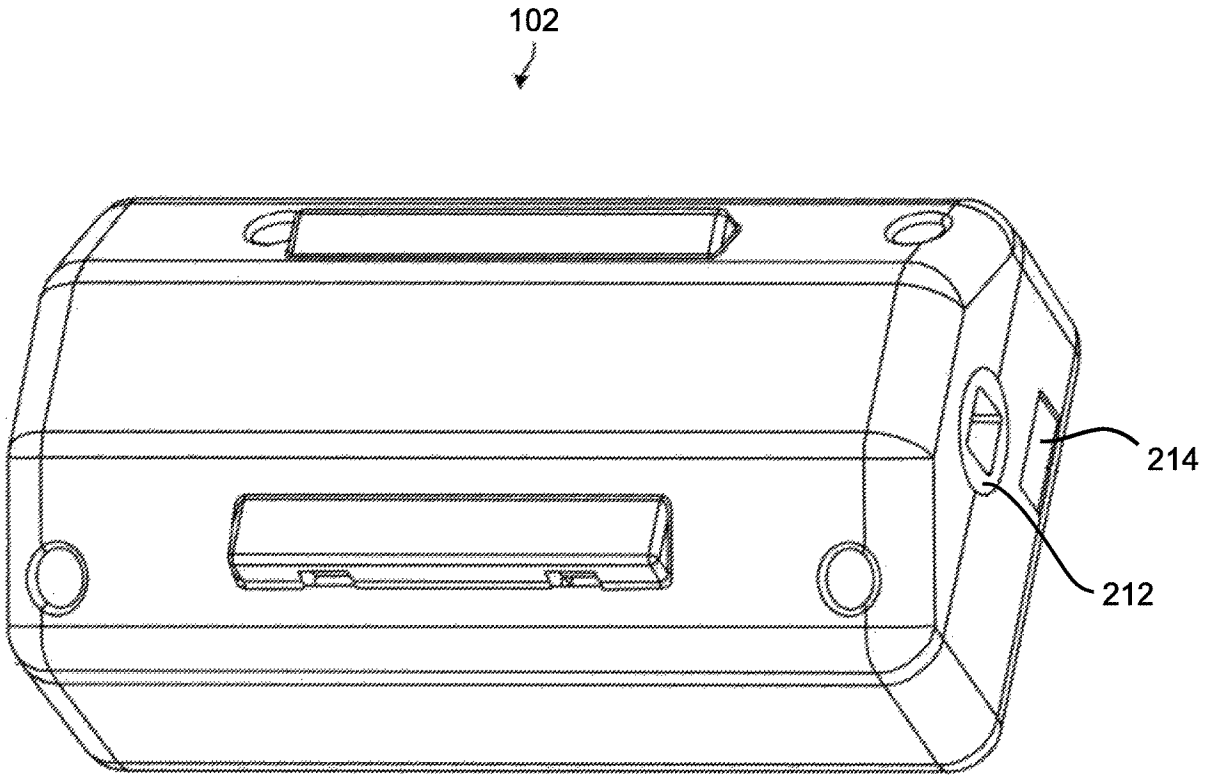
FIG. 2 is an isometric view of one embodiment of a motorized gearbox assembly.

FIG. 2 is a perspective view of one embodiment of a motorized gearbox assembly 102. The motorized gearbox assembly 102 may have a substantially rectangular footprint to enable it to fit within the headrail (see FIG. 1) of the window covering (see FIG. 1). An output shaft 212 of the motorized gearbox assembly 102 may engage and apply torque to a tilt rod (see FIG. 1). An output port 214 may allow the motorized gearbox assembly 102 to connect to a battery and other external equipment or sensors.

Figure 3A:
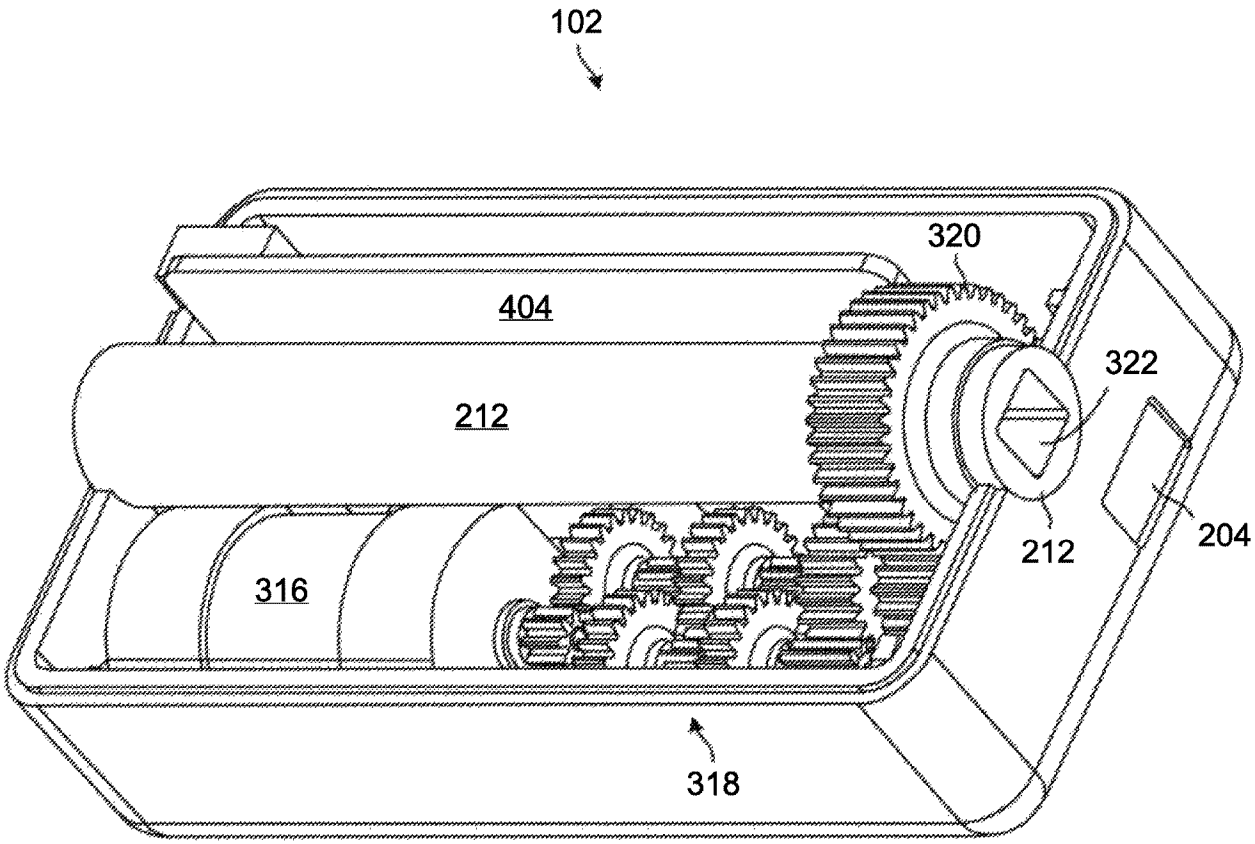
FIG. 3A is an isometric view of the inside of a motorized gearbox assembly, according to one embodiment, that shows various internal components.

FIG. 3A is a perspective view of the inside of a motorized gearbox assembly 102, according to one embodiment, that shows various internal components. The motorized gearbox assembly 102 includes a motor 316 and a power transmission system 318 having one or more stages of gears to reduce the gear ratio of the motor 316. The power transmission system 318 may drive a main gear 320 coupled to the output shaft 212. The output shaft 212 may, in turn, be used to drive the tilt rod 108. The output shaft 212 may extend the length of the motorized gearbox assembly 102 and include a through-channel 322 extending the length of the output shaft 212 through which the tilt rod 108 is enabled to pass. The output shaft 212 may adjacent to one or more sensors 332 of a safety detector 330.

Figure 3B:
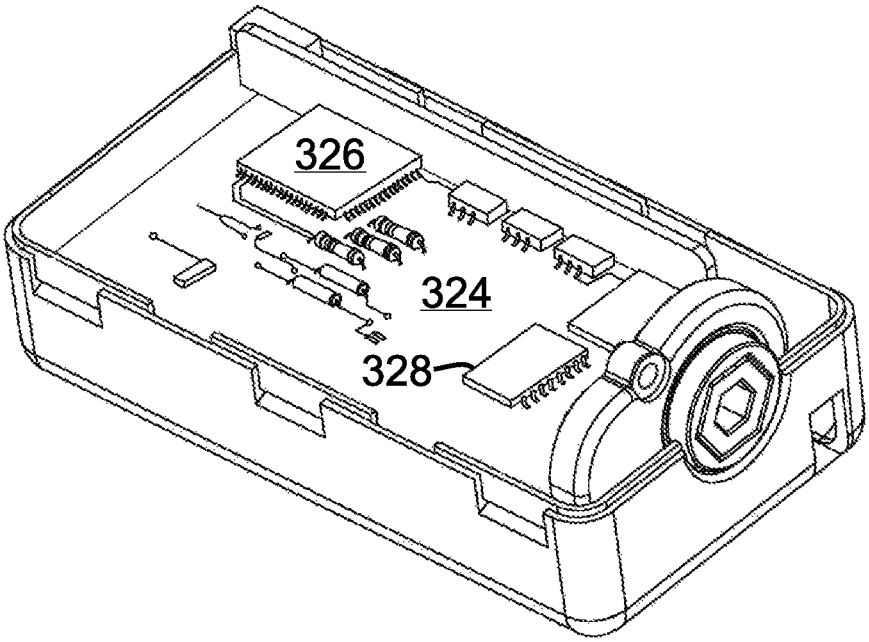
FIG. 3B is an isometric view of the inside of a motorized gearbox assembly, according to one embodiment, from which many internal components have been removed.

FIG. 3B is an isometric view of the inside of a motorized gearbox assembly 102, according to one embodiment, from which many internal components have been removed. Shown are a printed circuit board (PCB) 324, microcontroller 326, and transceiver 328. The microcontroller 326 may be operatively connected to the transceiver 328 via the PCB 324 and assist in actuating the motor (see FIG. 3A) to raise or lower the window covering and/or open and close slats (see FIG. 1) of the window covering. Additionally, the microcontroller 326 may be operatively connected to the safety detector (FIG. 3A) such that inputs from the safety detector may override inputs the microcontroller receives via the transceiver 328. The transceiver 328 may be wired or wireless, according to various embodiments, and receive a communication from a wired access control system, a remote control, a portable electronic device, or other functional control system.

Figure 4:
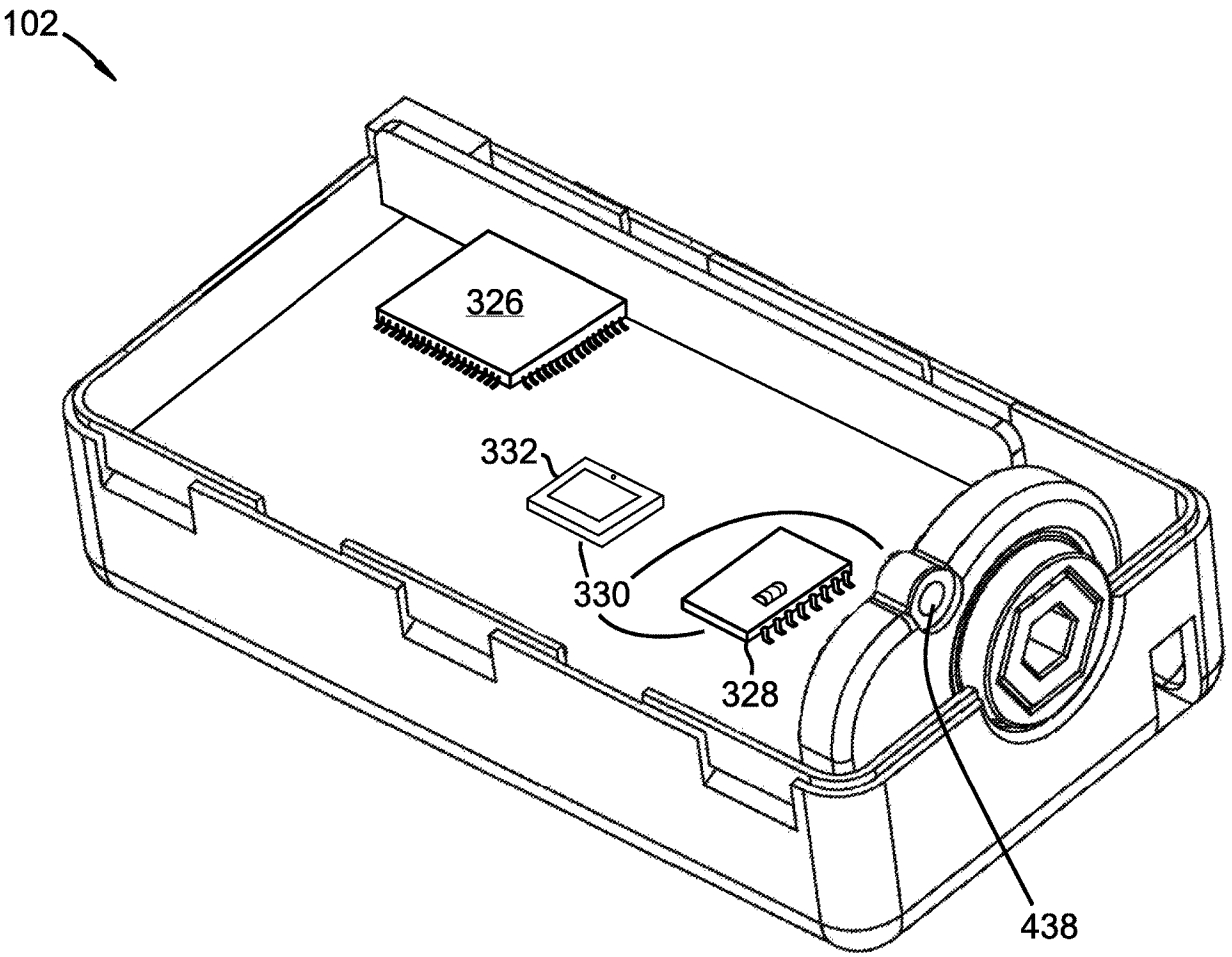
FIG. 4 is an isometric view of a motorized gearbox assembly with a safety detector, according to one embodiment.

FIG. 4 is an isometric view of a motorized gearbox assembly 102 with a safety detector 330, according to one embodiment. The safety detector 330 may include one or more sensors 332 such as a variable reluctance sensor, torque sensor, current sensor, shock detector, flex sensor, linear encoder, and/or position sensor. The safety detector 330 may be configured to detect strain on the output shaft (see FIG. 3A) when raising the window covering (see FIG. 1) that would be indicative of an irregular load. Specifically, the safety detector 330 may detect an increase in the amount of torque required to turn the output shaft of 10% or more from a preprogrammed threshold value that occurs when raising the window covering. This increase in torque of at least 10% would be indicative of at least a 10% increase in the load weight. The safety detector may also include a transceiver 328 for communicating real time sensor data to a microcontroller 326.

The transceiver 328 may be operatively connected to the microcontroller 326, which in turn is operatively connected to a recoil mechanism 438. The recoil mechanism 438 may be operatively connected to the motor (see FIG. 3A) and cancel inputs and/or deactivate preprogrammed settings as well as change the direction of the window covering's (see FIG. 1) movement such that the window covering (see FIG. 1) is lowered in response to a digital signal indicating that the load weight has increased at least 10%. The recoil mechanism 438 may loosen cords and/or strings, according to various embodiments, connected to the output shaft (see FIG. 3A) while lowering the window covering (see FIG. 1), which may be able to reduce the likelihood that individuals, particularly children, caught in the cords and/or strings are injured by raising the window covering.

Figure 5:
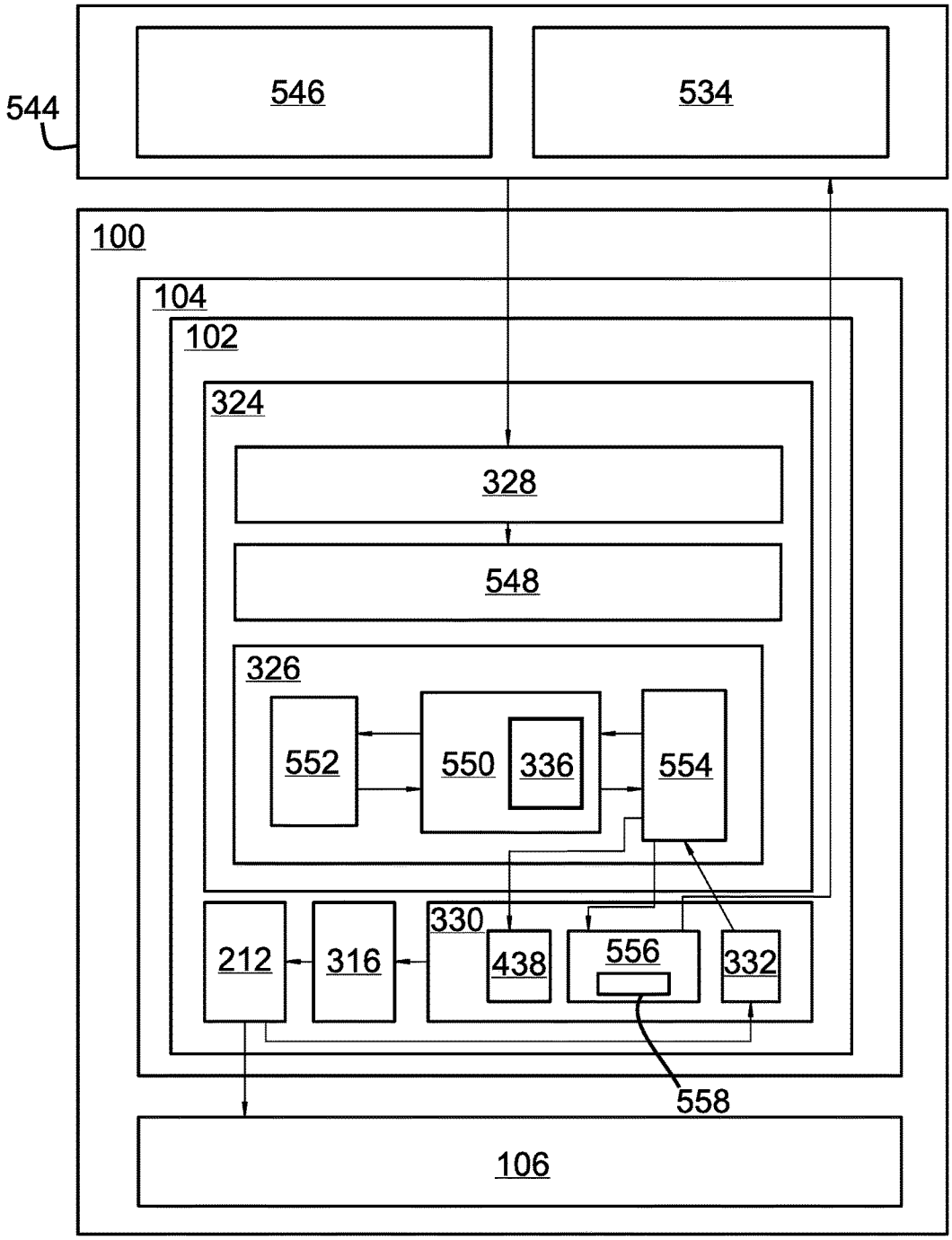
FIG. 5 is a functional block diagram for an embodiment of a headrail for motorized window coverings.

FIG. 5 is a functional block diagram for an embodiment of a headrail 104 for motorized window coverings 100. A transceiver 328 may receive a wireless or wired input from a personal electronic device 544 to raise or lower the window covering 100. The personal electronic device 544 may be a mobile phone, tablet, laptop computer, or the like, according to various embodiments. In one embodiment, the personal electronic device 544 may include a user interface 546 operatively connected to a processor 534. The user interface 546 may include a monitor or other display, printer, speech or text synthesizer, graphical user interface, or other hardware with accompanying firmware and/or software. The personal electronic device 544 may comprise one or more input/output interfaces that facilitate user interfacing. The input interface(s) may include a keyboard, mouse, button, touch screen, light pen, tablet, microphone, sensor, or other hardware with accompanying firmware and/or software. The personal electronic device 544 may include one or more software modules and/or processor modules for providing instructions to send to the motorized window covering 100.

The transceiver 328 may transmit the input received from the personal electronic device 544 to an analog-to-digital converter 548, which then sends a digital signal to various modules within the motorized gearbox assembly 102. The motorized gearbox assembly 102 may include a microcontroller 326 that is operatively connected to the transceiver 328 via the PCB 324. The microcontroller 326 may actuate the motor 316 to raise or lower the window covering 100 and/or open and close slats 106. The microcontroller 326 may comprise one or more computer processing units (CPUs) 550, a database 552, and input/output peripherals 554. The microcontroller 326 may include a comparator 336 that compares the torque applied by the output shaft 212, and detected by one or more sensors 332 of the safety detector 330, in real time to a threshold value stored in the database 552 to determine whether the strain applied to the window covering 100 as it rises is unusually high. If the torque applied by the output shaft 212 is high, then the microcontroller 326 may emit an digital signal to the recoil mechanism 438 to lower the window covering 100.

The safety detector 330 may include a communications system 556 that emits an alert signal 558 to communicate to a user of the presence of the 10% increase in the expected load weight. The alert signal 558 may include an auditory, visual, or pulsating alert. The communication system 556, according to various embodiments, may be in communication with a wireless output device 560 that receives the alert signal 558. The wireless output device 560 may include a personal electronic device 544.

Figure 6:
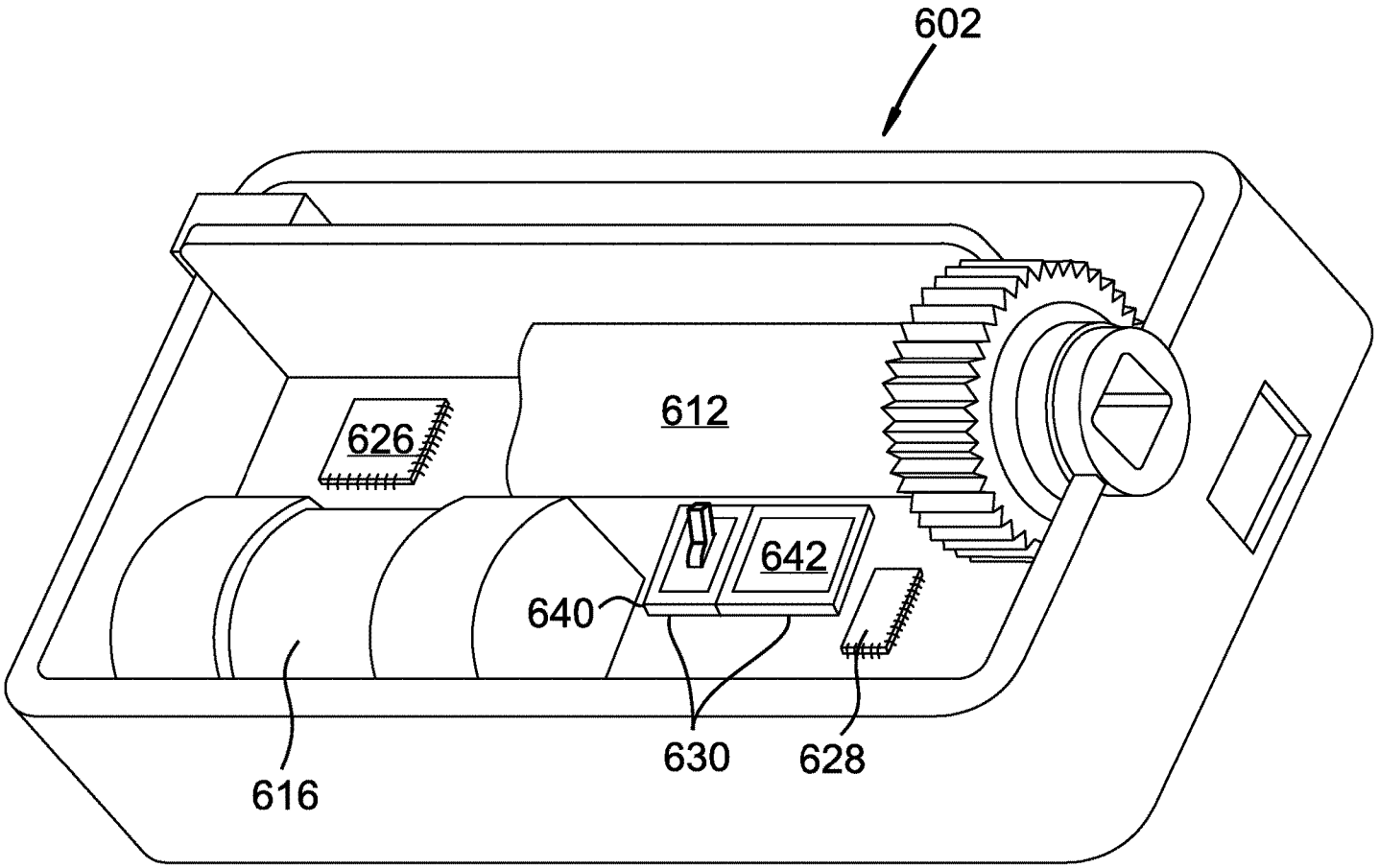
FIG. 6 is an isometric view of a motorized gearbox assembly with a safety detector comprising a deactivation mechanism, according to one embodiment.

FIG. 6 is an isometric view of a motorized gearbox assembly 602 with a safety detector 630 comprising a deactivation mechanism 640, according to one embodiment. The deactivation mechanism 640 may include a detector switch 642 that acts as a type of motion sensor that senses an increase in torque of the output shaft 612 as it rotates of at least 10%, which in turn shuts down power flow to the motor 616. The detector switch 642 may be attached to the output shaft 612, according to one embodiment, and work in conjunction with one or more additional sensors to detect strain on the output shaft 612. The detector switch 642 may be operatively connected to a transceiver 628 that is operatively connected to a microcontroller 626. The microcontroller 626 may operatively connect to the motor 616.

Figure 7:
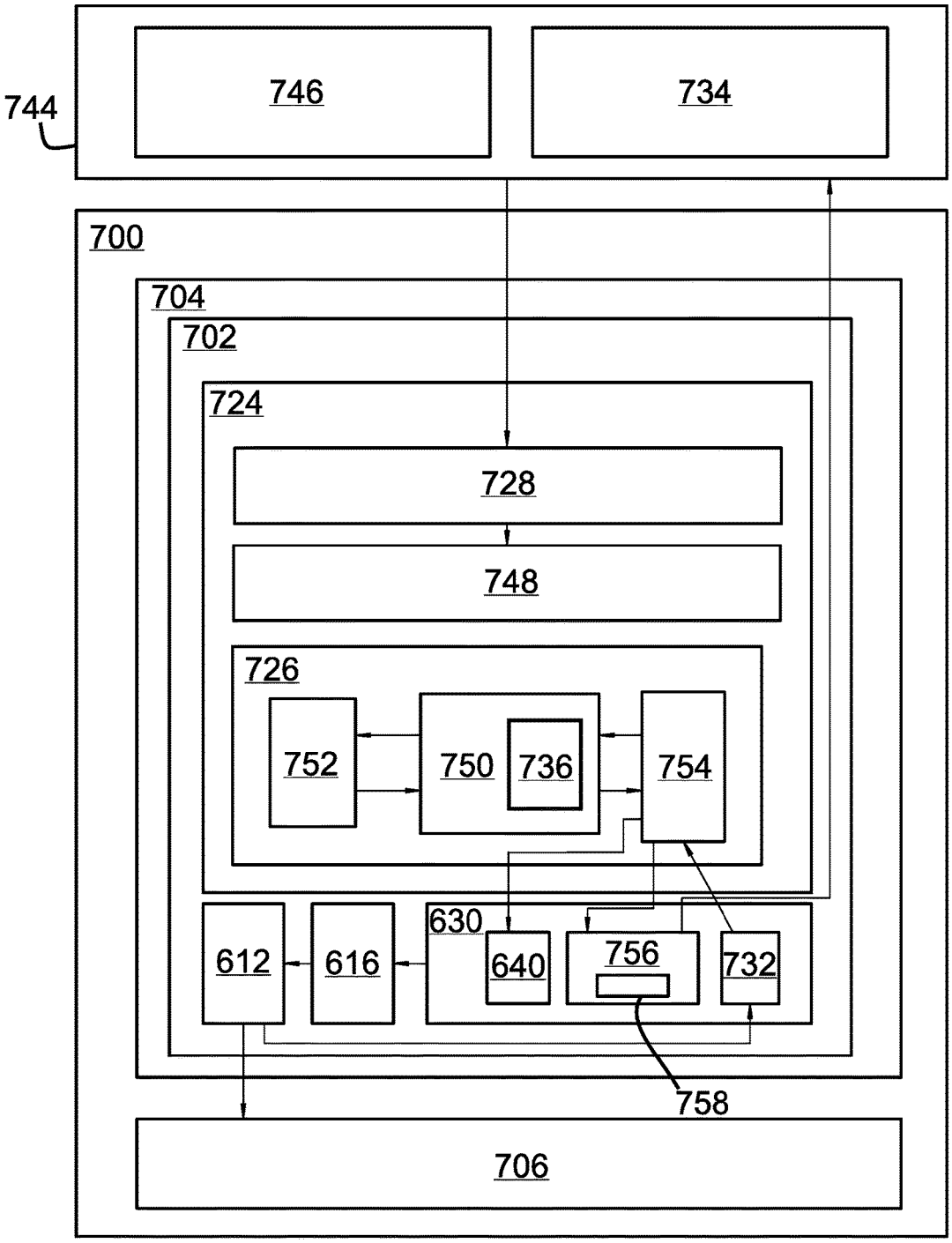
FIG. 7 is a functional block diagram for an embodiment of a headrail for motorized window coverings.

FIG. 7 is a functional block diagram for an embodiment of a headrail 704 for motorized window coverings 700. A transceiver 728 may receive a wireless or wired input from a personal electronic device 744 to raise or lower the window covering 700. The personal electronic device 744 may be a mobile phone, tablet, laptop computer, or the like, according to various embodiments. In one embodiment, the personal electronic device 744 may include a user interface 746 operatively connected to a processor 734. The user interface 746 may include a monitor or other display, printer, speech or text synthesizer, graphical user interface, or other hardware with accompanying firmware and/or software. The personal electronic device 744 may comprise one or more input/output interfaces that facilitate user interfacing. The input interface(s) may include a keyboard, mouse, button, touch screen, light pen, tablet, microphone, sensor, or other hardware with accompanying firmware and/or software. The personal electronic device 744 may include one or more software modules and/or processor modules for providing instructions to send to the motorized window covering 700.

The transceiver 728 may transmit the input received from the personal electronic device 744 to an analog-to-digital converter 748, which then sends a digital signal to various modules within the motorized gearbox assembly 702. The motorized gearbox assembly 702 may include a microcontroller 726 that is operatively connected to the transceiver 728 via the PCB 724. The microcontroller 726 may actuate the motor 616 to raise or lower the window covering 700 and/or open and close slats 706. The microcontroller 726 may comprise one or more computer processing units (CPUs) 750, a database 752, and input/output peripherals 754. The microcontroller 726 may include a comparator 736 that compares the torque applied by the output shaft 612, and detected by one or more sensors 732 of the safety detector 630, in real time to a threshold value stored in the database 752 to determine whether the strain applied to the window covering 700 as it rises is unusually high. If the torque applied by the output shaft 612 is high, then the microcontroller 726 may emit a digital signal to the deactivation mechanism 640.

The safety detector 630 may include a communications system 756 that emits an alert signal 758 to communicate to a user of the presence of the increase of at least 10% in the expected load weight. The alert signal 758 may include an auditory, visual, or pulsating alert. The communication system 756, according to various embodiments, may be in communication with a wireless output device 760 that receives the alert signal 758. The wireless output device 760 may include a personal electronic device 744.

The invention claimed is:

1. A headrail for motorized window coverings comprising:

a motor;

a gearbox coupled to the motor and comprising an output shaft that raises and lowers and/or opens and closes slats for a window covering;

a safety detector comprising:

one or more sensors within the gearbox and adjacent to the output shaft that detect an increase in torque required to turn the output shaft of 10% or more from a preprogrammed threshold value when raising the window covering that is indicative of at least a 10% increase in load weight;

a transceiver for communicating real time sensor data to a microcontroller; and a recoil mechanism, operatively connected to the transceiver, which in turn is operatively connected to the microcontroller that cancels inputs and/or deactivates preprogrammed settings in response to a digital signal indicating the load weight has increased at least 10%, and communicates with the motor to change the window covering's direction of movement, which thereby loosens cords and/or strings connected to the output shaft in order to lower the window covering.

2. The headrail of claim 1, wherein the one or more sensors comprise a variable reluctance sensor, torque sensor, current sensor, shock detector, flex sensor, linear encoder, and/or position sensor.

3. The headrail of claim 1, wherein the safety detector further comprises an analog-to-digital converter.

4. The headrail of claim 1, wherein the safety detector further comprises a processor for computing sensor data.

5. The headrail of claim 1, wherein the safety detector further comprises a database for recording sensor data and storing data for data comparisons.

6. The headrail of claim 1, wherein the microcontroller further comprises a comparator for comparing real-time load inputs to previously stored load data and sending a digital signal to the recoil mechanism that the load weight has increased at least 10% from an expected threshold.

7. The headrail of claim 1, wherein the sensor detector further comprises a communication system that emits an alert signal to communicate to a user that the load weight has increased at least 10%.

8. The headrail of claim 7, wherein the alert signal comprises an auditory, visual, or pulsating alert.

9. The headrail of claim 7, wherein the communication system is in communication with a wireless output device for receiving the alert signal.

10. A headrail for motorized window coverings comprising:

a motor;

a gearbox coupled to the motor and comprising an output shaft that raises and lowers and/or opens and closes slats for a window covering;

a safety detector comprising:

one or more sensors within the gearbox and adjacent to the output shaft that detect an increase in torque required to turn the output shaft of 10% or more from a preprogrammed threshold value when raising the window covering that is indicative of at least a 10% increase in load weight;

a transceiver for communicating real time sensor data to a microcontroller; and a deactivation mechanism, operatively connected to the transceiver, which in turn is operatively connected to the microcontroller that sends a digital signal to the motor to deactivate in order to stop further raising of the window covering.

11. The headrail of claim 10, wherein the one or more sensors comprise a variable reluctance sensor, torque sensor, current sensor, shock detector, flex sensor, linear encoder, and/or position sensor.

12. The headrail of claim 10, wherein the safety detector further comprises an analog-to-digital converter.

13. The headrail of claim 10, wherein the safety detector further comprises a processor for computing sensor data.

14. The headrail of claim 10, wherein the safety detector further comprises a database for recording sensor data and storing data for data comparisons.

15. The headrail of claim 10, wherein the microcontroller further comprises a comparator for comparing real-time load inputs to previously stored load data and sending a digital signal to the deactivation mechanism when the load is higher then an expected threshold.

16. The headrail of claim 10, wherein the safety detector further comprises a communication system that emits an alert signal to communicate to a user of that the load weight has increased at least 10%.

17. The headrail of claim 16, wherein the communication system further comprises a timer for sending a repeating alert at periodic increments.

18. The headrail of claim 16, wherein the alert signal comprises an auditory, visual, or pulsating alert.

19. The headrail of claim 16, wherein the communication system is in communication with a wireless output device for receiving the alert signal.

20. The headrail of claim 19, wherein the output device further comprises a user interface.

* * * * *